US009334864B2

(12) United States Patent
Wilder

(10) Patent No.: US 9,334,864 B2
(45) Date of Patent: May 10, 2016

(54) METHOD OF OPERATING A PUMPING SYSTEM

(75) Inventor: Anthony John Wilder, Hove (GB)

(73) Assignee: Edwards Limited, Crawley, West Sussex (GB)

( * ) Notice: Subject to any disclaimer, the term of this patent is extended or adjusted under 35 U.S.C. 154(b) by 1556 days.

(21) Appl. No.: 11/992,684

(22) PCT Filed: Sep. 20, 2006

(86) PCT No.: PCT/GB2006/003473

§ 371 (c)(1),
(2), (4) Date: Aug. 3, 2009

(87) PCT Pub. No.: WO2007/042747

PCT Pub. Date: Apr. 19, 2007

(65) Prior Publication Data

US 2009/0304524 A1 Dec. 10, 2009

(30) Foreign Application Priority Data

Oct. 7, 2005 (GB) ..... 0520470.6

(51) Int. Cl.
*F04B 49/06* (2006.01)
*F04C 28/08* (2006.01)
*F04C 28/06* (2006.01)

(52) U.S. Cl.
CPC ..... *F04C 28/08* (2013.01); *F04C 28/06* (2013.01); *F04C 2270/60* (2013.01)

(58) Field of Classification Search
CPC ..... F04B 49/02; F04B 49/06; F04B 49/065; F04B 49/022; F04B 49/0207; F04B 2205/01; F04B 2205/05; F04B 2203/0204; F04B 2203/0207; F04C 2207/0441; F04C 2207/0442; F04C 2270/015; F04C 2270/025; F04C 2270/035; F04C 2270/095; F04C 2270/185; F04C 2270/215; F04C 28/06
USPC ..... 417/53, 42, 44.1, 44.11, 45
See application file for complete search history.

(56) References Cited

U.S. PATENT DOCUMENTS 3,753,069 A 8/1973 Newton
4,566,289 A 1/1986 Iizuka et al.

(Continued)

FOREIGN PATENT DOCUMENTS

DE 43 22 223 A1 1/1995
JP 57129196 A * 8/1982

(Continued)

OTHER PUBLICATIONS

JP 2005226980 A machine translation;Aug. 2005;Nakazato et al.*
JP08037788A abstract,Feb. 1996,Taniguchi et al.*
Tsuboi Katsutake; English language abstract of Publication No. JP1217160 A, entitled "Cooler," Mitsubishi Electric Corp; Aug. 30, 1989.

(Continued)

*Primary Examiner* — Charles Freay
(74) *Attorney, Agent, or Firm* — Westman, Champlin & Koehler, P.A.

(57) ABSTRACT

A pumping system has a motor (32) for driving a pumping mechanism (30). A variable frequency drive unit (36) has an input for receiving electrical energy of relatively high power and first, fixed frequency from a power supply, and an output coupled to an input (46) of the motor for supplying electrical energy of relatively low power and second, variable frequency to the motor. This second frequency preferably has a maximum value greater than the first frequency. A control circuit (50) is provided for selectively coupling the motor input (46) directly to the power supply for the supply of the relatively high power energy to the motor to maximize the torque that can be produced by the pumping mechanism. After a period of time the control circuit terminates the direct coupling of the motor input to the power supply for the supply of the relatively low power energy to the motor.

8 Claims, 3 Drawing Sheets

(56) References Cited

U.S. PATENT DOCUMENTS

| | | | | |
|---|---|---|---|---|
| 4,718,247 | A * | 1/1988 | Kobayashi et al. | 62/228.4 |
| 5,130,628 | A * | 7/1992 | Owen | H02M 5/10 290/38 R |
| 5,655,380 | A * | 8/1997 | Calton | H02P 27/04 236/78 D |
| 5,658,132 | A * | 8/1997 | Akazawa et al. | 417/45 |
| 2003/0098668 | A1 * | 5/2003 | Jadric et al. | 318/801 |
| 2004/0040323 | A1 | 3/2004 | Yokozeki et al. | |
| 2005/0162787 | A1 * | 7/2005 | Weigel | F04B 49/10 361/22 |

FOREIGN PATENT DOCUMENTS

| | | | |
|---|---|---|---|
| JP | 58-88482 | | 5/1983 |
| JP | 1-217160 | | 8/1989 |
| JP | 08037788 | A * | 2/1996 |
| JP | 2005226980 | A * | 8/2005 |
| WO | WO 2005/067135 | A1 | 7/2005 |

OTHER PUBLICATIONS

Tsutsui Toshiaki; English language abstract of Publication No. JP58088482 A, entitled "Running System of Submergible Pump," Nikkiso Co Ltd; May 26, 1983.

United Kingdom Search Report of Application No. GB0520470.6 mailed Apr. 7, 2006; Claims searched: All; Date of search: Apr. 6, 2006.

PCT Notification of Transmittal of the International Search Report and the Written Opinion of the International Searaching Authority, or the Declaration.

PCT International Search Report of International Application No. PCT/GB2006/003473; Date of mailing of the International Search Report: Dec. 22, 2006 of International Application No. PCT/GB2006/003473; Date of mailing: Dec. 22, 2006.

PCT Written Opinion of the International Searching Authority of International Application No. PCT/GB2006/003473; Date of mailing: Dec. 22, 2006.

* cited by examiner

METHOD OF OPERATING A PUMPING SYSTEM

FIELD OF THE INVENTION

The present invention relates to a method of operating a pumping system.

BACKGROUND OF THE INVENTION

Vacuum processing is commonly used in the manufacture of semiconductor devices and flat panel displays to deposit thin films on to substrates, and in metallurgical processes. Pumping systems used to evacuate relatively large process chambers to the desired pressure generally comprise at least one booster pump connected in series with at least one backing pump.

Booster pumps typically have oil-free pumping mechanisms, as any lubricants present in the pumping mechanism could cause contamination of the clean environment in which the vacuum processing is performed. Such "dry" vacuum pumps are commonly single or multi-stage positive displacement pumps employing inter-meshing rotors in the pumping mechanism. The rotors may have the same type of profile in each stage or the profile may change from stage to stage. The backing pumps may have either a similar pumping mechanism to the booster pumps, or a different pumping mechanism.

An asynchronous AC motor typically drives the pumping mechanism of a booster pump. Such motors must have a rating such that the pump is able to supply adequate compression of the pumped gas between the pump inlet and outlet, and such that the pumping speed resulting is sufficient for the duty required.

A proportion of the power supplied to the motor of the booster pump produces heat of compression in the exhaust gas, particularly at intermediate and high inlet pressure levels, such that the pump body and rotors can heat up. If the amount of compression and differential pressure generated is not adequately controlled, there may be a risk of overheating the booster pump, ultimately resulting in lubrication failure, excessive thermal expansion and seizure. The standard motor for the size and pumping speed of the booster pump is thus usually selected such that it should be able to supply adequate compression in normal use at low inlet pressures but a risk of overheating remains if the pump is operated at intermediate and high inlet pressure levels without a means of protection.

In the conventional pumping system described above, frequent and repeated operation at high to intermediate inlet pressures may be required. The amount of gas compression produced by the booster pump, and the differential pressure generated between its inlet and outlet, may be limited by various means to control the amount of heat generated and to limit the risk of overheating. If the gas compression produced by the booster pump is limited too severely, the resulting evacuation time of the large vacuum chamber may be undesirably slow. If the gas compression produced by the booster pump is not limited enough, whilst the resulting evacuation time of the vacuum chamber may be rapid the mechanical booster pump may overheat.

For driving the motor of a booster pump, a variable frequency drive unit may be provided between the motor and a power source for the motor. Such drive units may operate by converting the AC power supplied by the power source into a DC power, and then converting the DC power into an AC power of desired amplitude and frequency. The power supplied to the motor is controlled by controlling the current supplied to the motor, which in turn is controlled by adjusting the frequency and/or amplitude of the voltage in the motor. The current supplied to the motor determines the amount of torque produced in the motor, and thus determines the torque available to rotate the pumping mechanism. The frequency of the power determines the speed of rotation of the pumping mechanism. By varying the frequency of the power, the booster pump can maintain a constant system pressure even under conditions where the gas load may vary substantially.

The drive unit sets a maximum value for the frequency of the power ($f_{max}$), and a maximum value for the current supplied to the motor ($I_{max}$). This current limit will conventionally be appropriate to the continuous rating of the motor, and will limit the effective torque produced by the pumping mechanism and hence the amount of differential pressure resulting. This maximum current is typically the current that can be sustained indefinitely without overheating the motor.

At the start of a rapid evacuation cycle, it is desirable to rotate the pumping mechanism as rapidly as possible to maximise the evacuation rate. Due to the high pressure, and thus relatively high density, of the gas at the start of the cycle, a large torque is required to initiate rotation of the pumping mechanism at a frequency around $f_{max}$, and so there is a high current demand. The torque required to rotate the pumping mechanism may be increased when the pump is used to evacuate a process chamber in which particulates are generated as a by-product of the processing performed in the chamber. These particulates can accumulate within the pump and effectively fill the vacant running clearance between the rotor and stator components of the pumping mechanism. When the pump is stopped the rotor and stator components will cool and shrink. Due to the different thermal expansions of the rotor and stator components of the pump, the running clearances between the rotor and stator components reduce. However, if those running clearances are already full of particulates, then those particulates become crushed between the rotor and stator components, and can effectively apply a brake to the rotor components so that, in severe cases, the torque that can be produced by the supply of a current of $I_{max}$ from the drive unit to the motor is insufficient to re-start the pumping mechanism.

Whilst variable frequency drive units may be provided with an overload capability, the overload capability is usually around 150% of the rated power for a short term, time limited period, and so even when operated in an overload condition it may not be possible to re-start the pumping mechanism.

Despite this, an advantage associated with the overload capability of a variable frequency drive unit is that the motor can be deliberately operated in overload for a short period of time in order to reduce the time required to evacuate the chamber from atmospheric pressure to the desired low pressure (the "pump down" time). However, in the event that the overload time period is inadvertently exceeded, the frequency of the power supplied to the motor of the booster pump will be rapidly reduced to some level below $f_{max}$ to protect the motor from damage, resulting in a sharp reduction in the rotational speed of the pump while limiting the differential pressure produced. As the evacuation progresses and the inlet pressure decreases, the drive unit will ramp up the frequency towards $f_{max}$ over a finite period to gradually increase the rotational speed of the booster pump. While this protects the booster pump from overheating at all inlet pressures, this period when the rotational speed is reduced may represent an undesirable extension of the pump down time.

SUMMARY OF THE INVENTION

In a first aspect, the present invention provides a pumping system comprising a pumping mechanism, a motor for driving the pumping mechanism, a variable frequency drive unit having an input for receiving electrical energy of relatively high power and first frequency from a power supply and an output coupled to an input of the motor for supplying electrical energy of relatively low power and second, variable frequency to the motor, and a control circuit for selectively coupling the motor input directly to the power supply for the supply of said relatively high power energy to the motor to maximise the torque that can be produced by the pumping mechanism, and for subsequently terminating the direct coupling of the motor input to the power supply for the supply of said relatively low power energy from the drive unit to the motor.

In a second aspect the present invention provides a method of operating a pumping system comprising a pumping mechanism, a motor for driving the pumping mechanism and a variable frequency drive unit having an input for receiving electrical energy of relatively high power and first frequency from a power supply and an output coupled to an input of the motor for supplying electrical energy of relatively low power and second, variable frequency to the motor, the method comprising the steps of selectively coupling the motor input directly to the power supply for the supply of said relatively high power energy to the motor to maximise the torque that can be produced by the pumping mechanism, and subsequently terminating the direct coupling of the motor input to the power supply for the supply of said relatively low power energy from the drive unit to the motor.

In a third aspect the present invention provides a method of starting a pumping system comprising a pumping mechanism, a motor for driving the pumping mechanism and a variable frequency drive unit having an input for receiving electrical energy of relatively high power and first frequency from a power supply and an output coupled to an input of the motor for supplying electrical energy of relatively low power and second, variable frequency to the motor, the method comprising the steps of initially selectively coupling the motor input directly to the power supply for the supply of said relatively high power energy to the motor to start the pumping mechanism, and subsequently terminating the direct coupling of the motor input to the power supply for the supply of said relatively low power energy from the drive unit to the motor.

In a fourth aspect the present invention provides a method of operating a pumping system comprising a pumping mechanism, a motor for driving the pumping mechanism and a variable frequency drive unit having an input for receiving electrical energy of relatively high power and first frequency from a power supply and an output coupled to an input of the motor for supplying electrical energy of relatively low power and second, variable frequency to the motor, said second frequency having a maximum greater than the first frequency, the method comprising the steps of supplying said relatively low power energy from the drive unit to the motor, monitoring the variation of the second frequency, and when the second frequency is below, or a predetermined amount below, the first frequency, coupling the motor input directly to the power supply for the supply of said relatively high power energy to the motor.

BRIEF DESCRIPTION OF THE DRAWINGS

The present invention will now be described with reference to the accompanying drawing, in which.

DETAILED DESCRIPTION OF THE INVENTION

Figure 1:
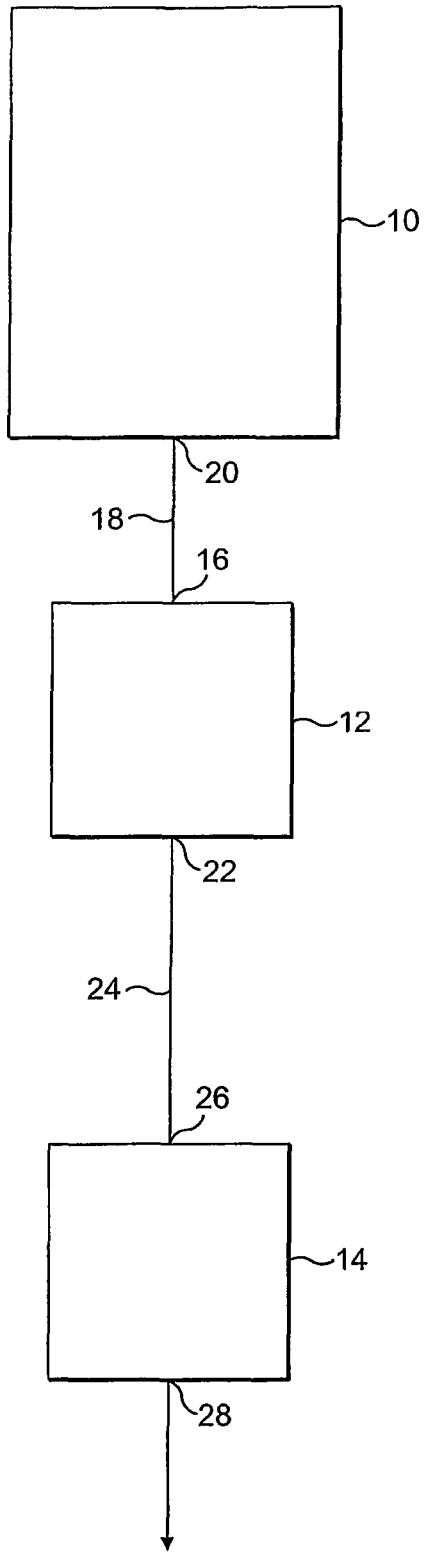
FIG. 1 illustrates schematically an example of a pumping system for evacuating an enclosure.

In a first aspect, the present invention provides a pumping system comprising a pumping mechanism, a motor for driving the pumping mechanism, a variable frequency drive unit having an input for receiving electrical energy of relatively high power and first frequency from a power supply and an output coupled to an input of the motor for supplying electrical energy of relatively low power and second, variable frequency to the motor, and a control circuit for selectively coupling the motor input directly to the power supply for the supply of said relatively high power energy to the motor to maximise the torque that can be produced by the pumping mechanism, and for subsequently terminating the direct coupling of the motor input to the power supply for the supply of said relatively low power energy from the drive unit to the motor.

By coupling the motor input directly to the power supply, the motor can draw a high current directly from the power supply to enable the motor to produce a typical overload of 250-300% rated torque. By supplying relatively high power energy to the motor, the torque that can be produced by the pumping mechanism can be significantly increased in comparison to the torque that can be produced from the energy supplied to the motor from the drive unit. This can significantly increase the likelihood of the pumping mechanism being re-started following a cessation of operation of the pumping mechanism. To avoid overheating of the motor, after a period of time the control circuit terminates the direct coupling of the motor input to the power supply for the supply of the relatively low power energy from the drive unit to the motor.

The second frequency preferably has a maximum greater than the first frequency. As energy may then be supplied at a higher frequency from the drive unit in comparison to the energy supplied directly from the power supply, typically at 100 Hz in comparison to 50 or 60 Hz from the power supply, the speed of the pumping mechanism can be maximised, and thus the pump down time can be minimised.

The control circuit preferably comprises connecting means for directly coupling the motor input to the power supply, and a controller for activating the connecting means. The connecting means may comprise switching means having a set of movable contacts coupled to the power supply, with the controller being configured to selectively activate movement of the contacts to directly couple the motor input to the power supply. As the output from the drive unit is coupled to the motor input, the contacts are preferably normally in an open position so that the motor input is normally not directly coupled to the power supply. Activation of the switching means by the controller causes the contacts to move to the closed position to directly couple the motor input to the power supply. When the switching means is activated, the controller deactivates the supply of energy from the drive unit, so that at any given time energy is supplied to the motor either directly from the power supply or from the drive unit. By permanently connecting the output from the drive unit to the motor, and controlling the output from the drive unit using commands issued by the controller, only a single set of moveable contacts is required to by-pass the drive unit, reducing the costs of the pumping system in comparison to an alternative arrangement where two sets of moveable contacts are used. The controller of the control circuit may be provided by a controller of the variable frequency drive unit, or by a separate controller.

As discussed above, the control circuit is preferably configured to couple the motor input directly to the power supply to start the pumping mechanism. In dependence on an operational characteristic of the pumping mechanism, for instance when the rotational frequency of the motor has reached a predetermined value, for example 50 or 60 Hz, the controller may be configured to terminate the direct coupling, in the preferred embodiment by moving the contacts to the open position, and activate the supply of power from the drive unit to the motor input so that the rotational frequency of the motor can be increased further, for example up to 100 Hz. A smooth transition from one power source to the other can be achieved using a frequency search function in the variable frequency drive unit to fly-catch the motor.

Alternatively, or additionally, the control circuit may be configured to receive input from at least one sensor for monitoring one or more states within the system, and to terminate the direct coupling in dependence on the monitored states. At least one sensor may be configured to supply a signal indicative of a gas pressure within the pumping system, for example the pressure of gas supplied to the pumping mechanism and/or the pressure of gas exhaust from the pumping mechanism. Alternatively, or additionally, at least one sensor may be configured to supply a signal indicative of a temperature of the pumping system, for example the body temperature of the pumping mechanism and/or the temperature of the gas entering the pumping mechanism at its inlet port and/or the temperature of the gas exhausting from the mechanism at its outlet port.

As another alternative, no external sensors may be utilised and instead the control circuit may control the termination of the direct coupling in dependence on time only, according to established system configuration and parameters.

The motor input may be coupled directly to the power source at any time during the operation of the pump. For instance, in the event that the current supplied to the motor from the drive unit exceeds $I_{max}$, for example in the event of a sudden excessive gas load on the pumping mechanism, the drive unit will be controlled to rapidly reduce the second frequency, that is the frequency of the power supplied to the motor by the drive unit. This will have the effect of reducing the speed of the pumping mechanism. In the event that the second frequency falls below the first frequency, that is the frequency of the power supplied directly to the motor from the power source, or falls a predetermined amount below that frequency, the control circuit may advantageously couple the motor input directly to the power supply to prevent the rotational speed of the pump falling further. The control circuit may then monitor an operational parameter of the pumping system, and subsequently terminate the direct coupling in dependence on that parameter, for example when the current drawn by the motor has fallen below a predetermined value sustainable by the drive unit, that is, below or around $I_{max}$, so that the rotational frequency of the pumping mechanism may be increased back towards the maximum value for the second frequency, which advantageously may be greater than the first frequency.

In a second aspect the present invention provides a method of operating a pumping system comprising a pumping mechanism, a motor for driving the pumping mechanism and a variable frequency drive unit having an input for receiving electrical energy of relatively high power and first frequency from a power supply and an output coupled to an input of the motor for supplying electrical energy of relatively low power and second, variable frequency to the motor, the method comprising the steps of selectively coupling the motor input directly to the power supply for the supply of said relatively high power energy to the motor to maximise the torque that can be produced by the pumping mechanism, and subsequently terminating the direct coupling of the motor input to the power supply for the supply of said relatively low power energy from the drive unit to the motor.

In a third aspect the present invention provides a method of starting a pumping system comprising a pumping mechanism, a motor for driving the pumping mechanism and a variable frequency drive unit having an input for receiving electrical energy of relatively high power and first frequency from a power supply and an output coupled to an input of the motor for supplying electrical energy of relatively low power and second, variable frequency to the motor, the method comprising the steps of initially selectively coupling the motor input directly to the power supply for the supply of said relatively high power enemy to the motor to start the pumping mechanism, and subsequently terminating the direct coupling of the motor input to the power supply for the supply of said relatively low power energy from the drive unit to the motor.

In a fourth aspect the present invention provides a method of operating a pumping system comprising a pumping mechanism, a motor for driving the pumping mechanism and a variable frequency drive unit having an input for receiving electrical energy of relatively high power and first frequency from a power supply and an output coupled to an input of the motor for supplying electrical energy of relatively low power and second, variable frequency to the motor, said second frequency having a maximum greater than the first frequency, the method comprising the steps of supplying said relatively low power energy from the drive unit to the motor, monitoring the variation of the second frequency, and when the second frequency is below, or a predetermined amount below, the first frequency, coupling the motor input directly to the power supply for the supply of said relatively high power energy to the motor.

Features described above in relation to system aspects of the invention are equally applicable to method aspects of the invention, and vice versa.

FIG. 1 illustrates a vacuum pumping system for evacuating an enclosure 10, such as a process chamber or other relatively large chamber. The system comprises a booster pump 12 connected in series with a backing pump 14. The booster pump 12 has an inlet 16 connected by an evacuation passage 18, preferably in the form of a conduit 18, to an outlet 20 of the enclosure 10. The booster pump 12 further has an exhaust 22 connected by a conduit 24 to an inlet 26 of the backing pump 14. The backing pump 14 has an exhaust 28 that exhausts the gas drawn from the enclosure 10 to the atmosphere.

Whilst the illustrated pumping system includes a single booster pump and a single backing pump, any number of booster pumps may be provided depending on the pumping requirements of the enclosure. Where a plurality of booster pumps are provided, these are connected in parallel so that each booster pump can be exposed to the same operating conditions. Where a relatively high number of booster pumps are provided, two or more backing pumps may be provided in parallel. Furthermore, an additional row or rows of booster pumps similarly connected in parallel may be provided as required between the first row of booster pumps and the backing pumps.

Figure 2:
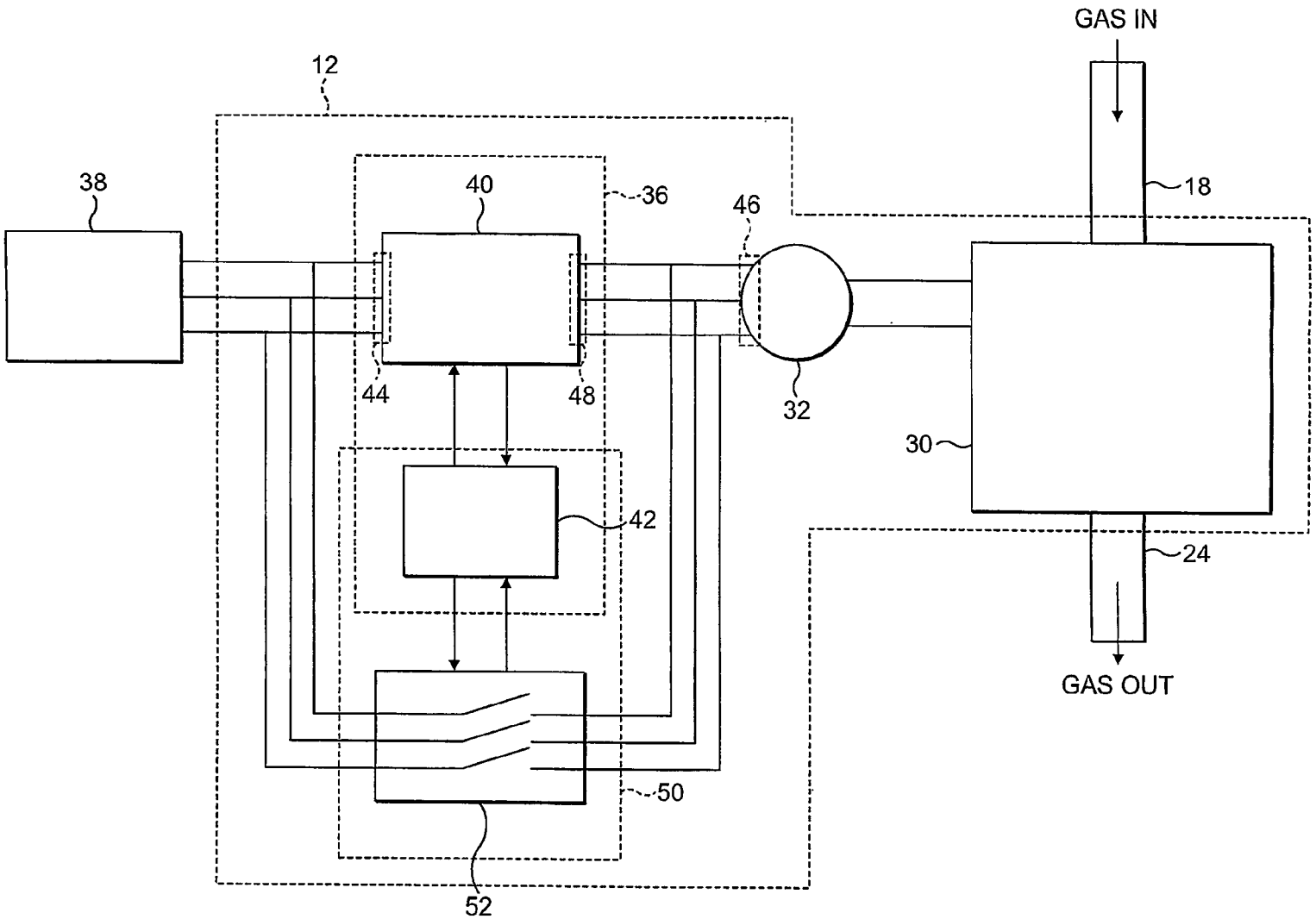
FIG. 2 illustrates schematically a first embodiment of a drive system for driving a motor of the booster pump of the pumping system of FIG. 1.

With reference also to FIG. 2, the booster pump 12 comprises a pumping mechanism 30 driven by a variable speed motor 32. Booster pumps typically include an essentially dry (or oil free) pumping mechanism 30, but generally also include some components, such as bearings and transmission gears, for driving the pumping mechanism 30 that require lubrication in order to be effective. Examples of dry pumps include Roots, Northey (or "claw") and screw pumps. Dry pumps incorporating Roots and/or Northey mechanisms are commonly multi-stage positive displacement pumps employing intermeshing rotors in each pumping chamber. The rotors are located on contra-rotating shafts, and may have the same type of profile in each chamber or the profile may change from chamber to chamber.

The backing pump 14 may have either a similar pumping mechanism to the booster pump 12, or a different pumping mechanism. For example, the backing pump 14 may be a rotary vane pump, a rotary piston pump, a Northey, or "claw", pump, or a screw pump.

The motor 32 of the booster pump 12 may be any suitable motor for driving the pumping mechanism 30 of the booster pump 12. In the preferred embodiment, the motor 32 comprises an asynchronous AC motor. A control system for driving the motor 32 comprises a variable frequency drive unit 36 for receiving electrical energy of a relatively high power and first, fixed frequency of typically 50 Hz or 60 Hz supplied by a three phase power supply 38 and converting the received energy into relatively low power electrical energy for supply to the motor 32.

The drive unit 36 comprises an inverter 40 and a controller 42. As is known, the inverter 40 has an inverter input 44 for receiving AC power from the power supply 38. The inverter 40 may comprise a rectifier circuit for converting the AC power from the power supply 38 to a pulsating DC power, an intermediate DC circuit for filtering the pulsating DC power to a DC power, and an inverter circuit for converting the DC power into an AC power that is supplied to the input 46 of the motor 32 from inverter output 48.

The controller 42 may control the operation of the inverter 40 so that the electrical energy supplied to the motor 32 has a desired amplitude and frequency. The controller 42 may adjust the amplitude and frequency of the energy in dependence on an operational state of the pumping system, for example at least one of the gas pressure in the conduit 18 and the gas pressure in the conduit 24. Information regarding this state of the pumping system may be provided directly to the controller 42 from one or more sensors, or from a separate controller. When the frequency of the energy output from the inverter 40 varies, the speed of rotation of the motor 32 varies in accordance with the change in frequency. The drive unit 36 is thus able to vary the speed of the booster pump 12 during the evacuation of the enclosure 10 to optimise the performance of the booster pump 12.

The controller 42 sets values for two or more operational limits of the drive unit 36; in particular, the maximum frequency of the energy supplied to the motor 32 ($f_{max}$), and the maximum current that can be supplied to the motor 32 ($I_{max}$). As mentioned above, the value of $I_{max}$ is normally set so that it is appropriate to the continuous rating of the motor 32, that is, the power at which the motor 32 can be operated indefinitely without reaching an overload condition, and its maximum value is ultimately restricted by the capacity of the inverter 40. In this example, the maximum frequency of the energy supplied to the motor 32 is set at or around 100 Hz, that is, greater than the frequency of the energy supplied from the power supply 38, although the maximum frequency may be equal to, or lower than, the first frequency.

Setting a maximum to the power supplied to the motor has the effect of limiting the effective torque available to the pumping mechanism 30. This in turn will limit the resulting differential pressure across the booster pump 12, and thus limit the amount of heat generated within the booster pump 12 so as to prevent overheating.

As mentioned above, the enclosure 10 may be a process chamber. During processes such as chemical vapour deposition processing, the gas stream pumped from the process chamber can contain species that may cause premature failure of the pump. For example, some deposition processes generate particulates that are exhaust from the process chamber with the unconsumed process gases. These particulates can accumulate within the booster pump 12 and effectively fill the vacant running clearance between the rotor and stator components of the pumping mechanism 30. When the pump 12 is stopped the rotor and stator components will cool and shrink. Due to the different thermal expansions of the rotor and stator components of the pump, the running clearances between the rotor and stator components reduce. However, if those running clearances are already full of particulates, then those particulates become crushed between the rotor and stator components, and can effectively apply a brake to the rotor components. In severe cases, this may prevent restart of the pump 12, as the maximum torque that can be produced by the supply of energy from the drive unit 36 without exceeding $I_{max}$ may be insufficient to overcome the frictional force acting on the rotor components.

In view of this, the drive system for the booster pump 12 comprises a control circuit 50 for selectively directly coupling the motor input 46 to the power supply 38 for the supply of relatively high power energy to the motor. As the motor 32 can draw a high current directly from the power supply 38, this can maximise the torque that can be produced by the pumping mechanism 30 for a period of time sufficient to overcome the frictional forces acting on the rotors of the pumping mechanism 30 to start the pump 12. In this example, the control circuit 50 comprises the controller 42 of the drive unit 36 and a set of switches or contactors 52 that are connected between the power supply 38 and the motor input 46. The contactors 52 are moveable in response to a signal received from the controller 42 between an open position, as illustrated in FIG. 2, in which the motor input 46 is connected only to the inverter output 48, and a closed position in which the motor input 46 is connected both directly to the power supply 38 and to the inverter output 48.

The contactors 52 are normally in the open position, and close in response to a command from the controller 42. The inverter 40 is normally in an off state, so that no energy is output from the inverter output 48 to the motor input 46, and is placed in an on state by a command from the controller 42.

In use, when the booster pump 12 is to be started, the power supply 38 is switched on and the inverter 40 powers up awaiting a command from the controller 42 to output energy to the motor input 46. The controller 42 issues a command to the contactors 52 to move to the closed position to directly couple the motor input 46 to the power supply 38, by-passing the inverter 40. The power of the electrical energy supplied to the motor 32 by the power supply 38 is high enough to overcome any frictional forces acting on the rotor components to start the pump 12. Following the lapse of a predetermined time period, or once the rotational speed of the pumping mechanism, or the current drawn by the motor 32, is at a certain value, the controller 42 issues a command to the contactors 52 to move to the open position to terminate the direct coupling of the motor input 46 to the power supply 38, and issues another command to the inverter to output energy from the inverter output 48. As well as inhibiting overloading of the pump 12, switching the energy supply to the output from the inverter 40 can maximise the speed of the pumping mechanism, and thereby minimise the pump down time of the enclosure, when the maximum frequency $f_{max}$ of the energy supplied from the inverter 40 is greater than the energy supplied from the power supply 38. A smooth transition between the sources of electrical energy for the motor 32 can be achieved using a frequency search function to fly-catch the motor 32.

Figure 3:
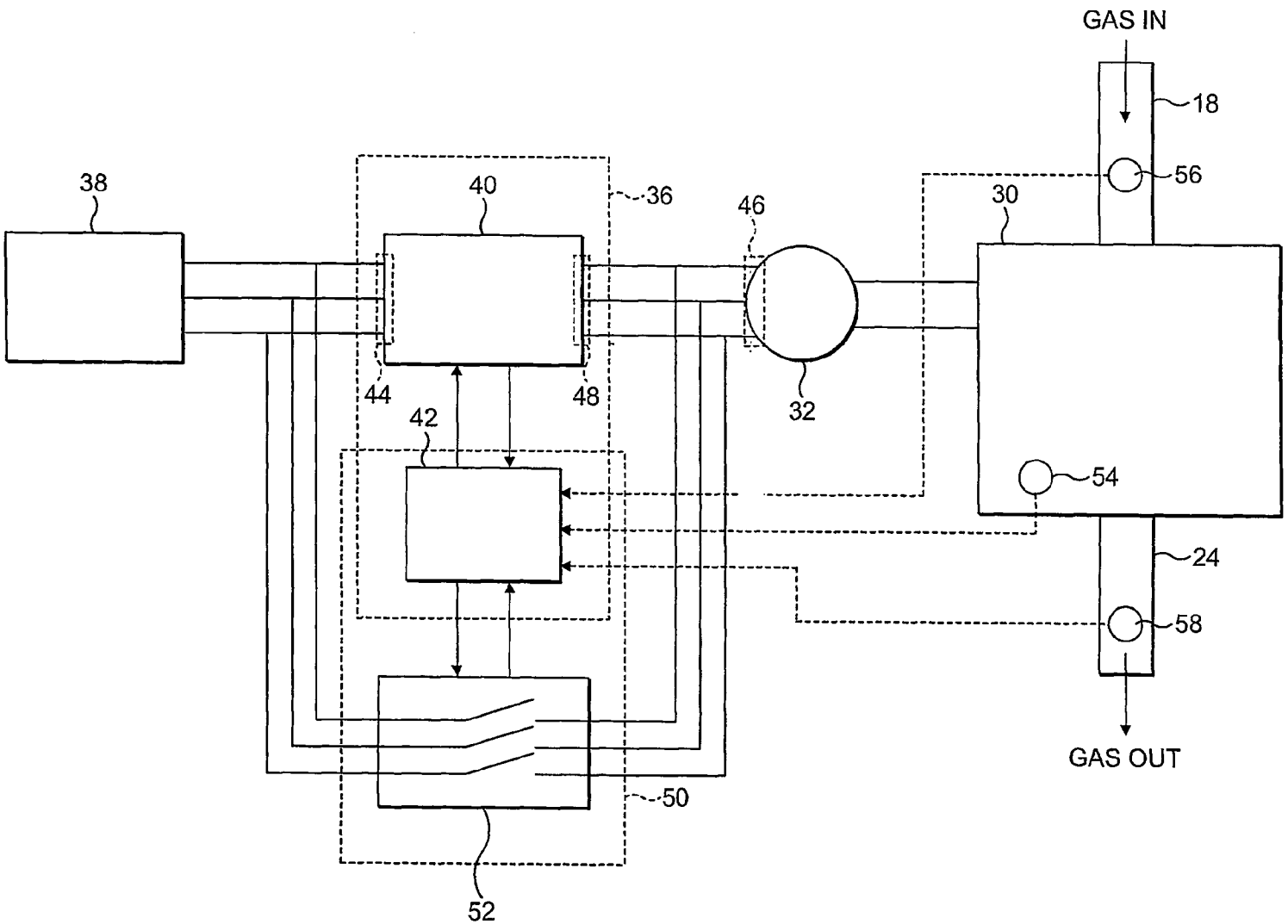
FIG. 3 illustrates schematically a second embodiment of a drive system for driving a motor of the booster pump of the pumping system of FIG. 1.

The transition between the sources of electrical energy for the motor 32 may alternatively be effected in dependence on one or more operational parameters of the pumping system. FIG. 3 illustrates an example of an arrangement of sensors for monitoring one or more operational states of the pumping system 10 and providing signals indicative of the operational states to the controller 42 for use in switching between the energy sources for the motor 32. The arrangement comprises a temperature sensor 54 for monitoring the temperature of the pumping mechanism 30. In this arrangement, the sensor 54 may be mounted on the external surface of the pumping mechanism, and output a signal to the controller 42 indicative of the temperature of the pumping mechanism 30. In dependence on the signal, for example, when the temperature of the pumping mechanism 30 exceeds a predetermined value, the controller 42 may terminate the direct coupling of the motor input 46 to the power supply 38 and instruct the inverter 40 to output energy from the inverter output 48 to the motor input 46.

One or more pressure sensors 56, 58 may also be provided. The controller 42 may receives a first signal indicative of the pressure at the inlet 16 of the booster pump 12 from a first pressure sensor 56 for detecting the pressure within the conduit 18. Alternatively, or in addition, the controller 42 may receive a second signal indicative of the pressure at the exhaust 22 of the booster pump 12 from a second pressure sensor 58 for detecting the pressure within the conduit 24. The controller 42 may change the source of electrical energy to the motor input 46 in dependence on one, or both, of the first and second signals.

Returning to FIG. 2, the controller 42 subsequently monitors the current supplied to the motor 32 by the inverter 40. The current supplied to the motor 32 is dependent upon the values of the frequency and amplitude of the AC power supplied to the motor 32 by the inverter 40. In the event that the current supplied to the motor 32 exceeds $I_{max}$, for example due to a transient increase in the amount of gas entering the pump 12, the controller 42 controls the inverter 40 to rapidly reduce the frequency of the power supplied to the motor 32 thereby reducing the speed of the booster pump 12. In the event that the frequency of the power supplied to the motor 32 from the inverter 40 reduces below the frequency at which power can be supplied to the motor 32 directly from the power supply 38, or a predetermined amount, say 1 or 2 Hz below that frequency, the controller 42 is preferably configured to switch the power sources for the motor 32 by issuing a command to the inverter 40 to stop supplying electrical energy to the inverter output 48, and to issue a command to the contactors 52 to move to the closed position to directly couple the motor input 46 to the power supply 48. This prevents the frequency of rotation of the pumping mechanism 30 from falling below, or a predetermined amount below, the frequency of the power supplied to the motor 32 by the power supply 38.

There is a risk of overheating either or both the pump and motor when supplying energy directly from the power supply 38 if the pumping load is too high or too prolonged. In view of this, the controller 42 monitors the current drawn by the motor 32, which will tend to decrease as the pressure of the gas entering the booster pump 12 decreases as less torque is required to rotate the pumping mechanism. When the current has fallen to a value that can be sustained by the inverter, that is, below or around $I_{max}$, the controller 42 issues a command to the contactors 52 to move to the open position to terminate the direct coupling of the motor input 46 to the power supply 38, and issues another command to the inverter to output energy from the inverter output 48. As well as inhibiting overloading of the pump 12, switching the energy supply to the output from the inverter 40 can again maximise the speed of the pumping mechanism, and thereby minimise the pump down time of the enclosure, when the maximum frequency $f_{max}$ of the energy supplied from the inverter 40 is greater than the energy supplied from the power supply 38. As mentioned above, a smooth transition between the sources of electrical energy for the motor 32 can be achieved using a frequency search function to fly-catch the motor 32.

Whilst the invention has been described above in relation to the control of the motor of the booster pump 12, the invention may equally applied to the control of the motor of the backing pump 14, or indeed to the control of the motor of any other type of pump.

While the foregoing description and drawings represent the preferred embodiments of the present invention, it will be apparent to those skilled in the art that various changes and modifications may be made therein without departing from the true spirit and scope of the present invention.

I claim:

1. A method of operating a pumping system comprising a pumping mechanism, a motor for driving the pumping mechanism and a variable frequency drive unit having an input for receiving alternating current of relatively high power and first frequency from a power supply and an output coupled to an input of the motor for supplying alternating current of relatively low power and second, variable frequency to the motor, the second frequency having a maximum greater than the first frequency, the method comprising:

supplying alternating current to the pump via the variable frequency drive unit;

reducing the frequency of the alternating current supplied by the variable frequency drive unit to produce a reduced frequency alternating current in response to an increase in a magnitude of the alternating current drawn by the motor from the variable frequency drive unit;

determining that the frequency of the reduced frequency alternating current is below the first frequency and in response, coupling the motor input directly to the power supply for the supply of said relatively high power alternating current to the motor.

2. The method according to claim 1 wherein the pumping system comprises a set of movable contacts coupled to the power supply, movement of the contacts being selectively activated to directly couple the motor input to the power supply.

3. The method according to claim 2 wherein the contacts are moved from an open to a closed position to directly couple the motor input to the power supply.

4. The method according to claim 1 wherein the direct coupling is terminated according to a predetermined timing relationship.

5. The method according to claim 1 wherein the direct coupling is terminated in dependence on an operational characteristic of the pumping system.

6. A method of operating a pumping system comprising a pumping mechanism, a motor for driving the pumping mechanism and a variable frequency drive unit having an input for receiving alternating current of relatively high power and first frequency from a power supply and an output coupled to an input of the motor for supplying alternating current of relatively low power and second, variable frequency to the motor, said second frequency having a maximum greater than the first frequency, the method comprising the steps of supplying said relatively low power alternating current from the drive unit to the motor, monitoring the second frequency, and when the monitoring indicates that the second frequency has reduced below, or a predetermined amount below, the first frequency, coupling the motor input directly to the power supply for the supply of said relatively high power alternating current to the motor.

7. The method according to claim 6 wherein the direct coupling of the motor input to the power supply is subsequently terminated for the supply of said relatively low power alternating current from the drive unit to the motor in dependence on the magnitude of the alternating current drawn by the motor.

8. The method of claim 1 wherein the direct coupling is terminated when the magnitude of the current drawn by the motor is determined to be below a sustainable value for the variable frequency drive unit.

* * * * *